United States Patent [19]

Zornes

[11] Patent Number: 4,901,787

[45] Date of Patent: Feb. 20, 1990

[54] REGENERATIVE HEAT EXCHANGER AND SYSTEM

[75] Inventor: Bruce L. Zornes, Bothell, Wash.

[73] Assignee: Balanced Engines, Inc., Tacoma, Wash.

[21] Appl. No.: 228,707

[22] Filed: Aug. 4, 1988

[51] Int. Cl.[4] ..... F28D 17/02

[52] U.S. Cl. ..... 165/4; 165/10; 60/526; 62/6

[58] Field of Search ..... 165/4, 10, 165, 164, 165/154, 135; 60/526; 62/6

[56] References Cited

U.S. PATENT DOCUMENTS

| | | | |
|---|---|---|---|
| 1,863,586 | 6/1932 | Wilbe | 165/165 |
| 3,148,512 | 9/1964 | Hoffman et al. | 62/6 |
| 3,216,484 | 11/1965 | Gifford | 165/4 |
| 3,397,738 | 8/1968 | Daunt | 62/6 |
| 3,692,095 | 9/1972 | Fleming | 165/10 |
| 4,209,061 | 6/1980 | Schwemin | 60/526 |

*Primary Examiner*—Albert W. Davis, Jr.
*Attorney, Agent, or Firm*—Seed and Berry

[57] ABSTRACT

A regenerative heat exchanger in which a compact arrangement of alternating thermally conductive and thermally insulating solid layers have an array of communicating passages therethrough. One of the outer thermally conductive layers is heated and the other is cooled. The intermediate thermally conductive layer(s) has a regenerative function when flow is alternated through the passages. Although each passage is preferably small, the total number of passages in the array is such as to give a large combined cross-sectional area for heat transfer providing improved overall performance and efficiency when incorporated in stirling and other heat engines without sacrificing structural integrity.

21 Claims, 3 Drawing Sheets

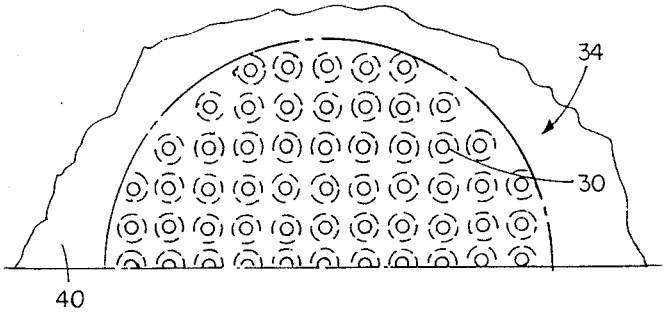
FIG. 5
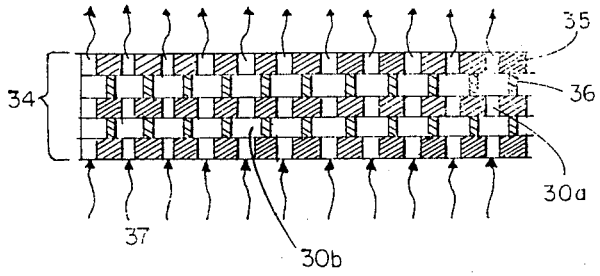
FIG. 6
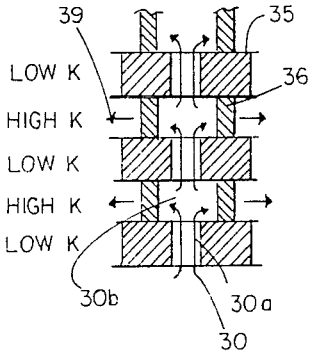
FIG. 7
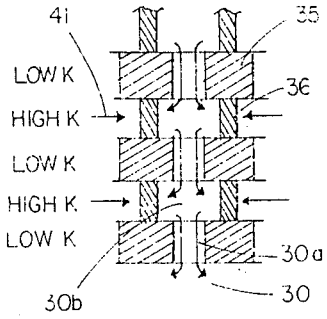
FIG. 8
FIG. 9
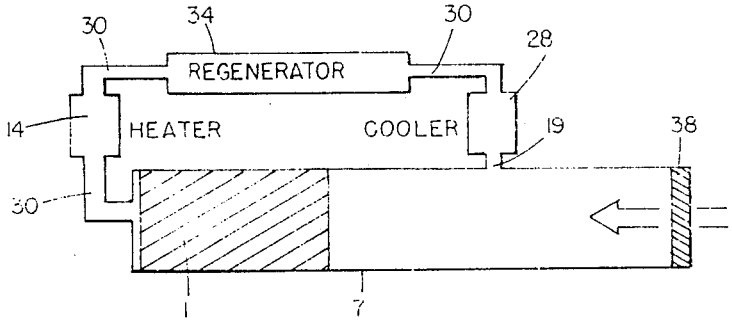

REGENERATIVE HEAT EXCHANGER AND SYSTEM

TECHNICAL FIELD

This invention relates to heat exchangers and regenerative heat exchanger systems for applications in, but not limited to, Stirling-type engines and refrigeration systems.

BACKGROUND

There exists in the United States today a renewed interest in the development of highly efficient external heat engines similar to the engine disclosed by Robert Stirling in 1816 and built in 1827. This engine is very simple in principle of operation, being no more than the tendency of a gas to expand when heated. Useful work or shaft power output can be derived from this expansion process. The Stirling engine cycle, which uses a regenerative heat exchange system, is known to be more efficient than either the Otto or Diesel cycles and can approach the theoretical limits of thermal efficiency as described by the well-known Carnot cycle. Also, a reciprocating piston, Stirling engine structure which uses a regenerative heat exchange system can be operated in reverse, that is to say, it can be driven by another power source, such as a Stirling engine, to make it an effective heat pump or refrigerator system.

The basic Stirling engine, and any other conventional heat engine for that matter, is comprised of a thermal energy source, a thermal energy sink (usually the atmosphere), and a means for converting available heat energy into useful mechanical energy. The heart of the Stirling engine, and most other external heat source engines, is in the ability and capability of the thermal management system to efficiently transport and exchange thermal energy available from the source to the sink.

Thermal management systems for Stirling-type heat engines and heat pumps are usually comprised of a working fluid capable of transporting thermal energy and generating working pressures, a heat exchanger component for energy input from the thermal source, a "regenerator," defined here as a device for rapid reversible thermal energy storage and recovery relative to said working fluid, and a heat exchanger component for energy rejection to the thermal sink. The efficiency and cost of heat exchangers and regenerators are of primary importance for the successful design of Stirling and other external-heat engines.

Present state-of-the-art heat exchanger system designs for reciprocating piston Stirling engines such as the United Stirling 4-95 are typically comprised of three basic components. The first component is a heat input heat exchanger which consists of parallel arrangements of high-temperature metal alloy tubes which may also be attached or welded to many heat fins or heat sinks to provide a larger convective and radiative area for heat exchange; the second component is a regenerator which consists of an enclosed in-line stack of fine mesh stainless metal screens; and the third component is a heat output heat exchanger which consists of an enclosed annular duct internally containing an arrangement of many metal fins which may be attached to a water-cooled outer wall. Said metal tubes for heat exchangers are typically composed of high-temperature, high-strength alloys containing strategic heavy elements, such as niobium, titanium, tungsten, cobalt, vanadium, and chromium, in addition to iron and carbon. This use of strategic elements drives up the basic material costs. The use of strategic metal alloys also drives up the cost of fabricating the parts due to the requirement for using non-standard and high-temperature forming methods. The heat exchanger system alone may account for 10 to 100 times the cost of all other components combined in state-of-the-art Stirling engines. The prohibitive cost, bulk, and weight of the state-of-the-art heat exchanger systems are the primary factors limiting the wide scale commercial development of external-combustion heat engines and refrigerator systems.

Stirling and other external-combustion heat engines which rely on a substantially closed loop arrangement of a conductive gas or multiphase fluid are particularly sensitive to the conditions of flow which exist throughout the heat exchange loop. The cross-sectional area and shape of the heat exchanger inlet and outlet ports are important design parameters which govern to a large extent the flow characteristics of a fluid under given pressure and temperature state variables which typically exist in reciprocating and free piston heat engines. As a rule of thumb, the cross-sectional area of the orifices through which the working fluid or heat energy transport medium must flow should be high relative to the cross-sectional area of the piston in order to achieve a relatively low Reynolds number or flow index. Competing with this is the desire to minimize the total volume of fluid participating in the heat exchange cycle and the desire to maximize the surface area available for the thermal energy exchange process which occurs between the working fluid and the walls of the flow passageways. State-of-the-art metal tubes tend to be few in number due to the high cost of the tubes, and each tube tends to have a small diameter, resulting in a low cross-sectional area. The low cross-sectional area in state-of-the-art heat exchangers causes adverse flow conditions for the primary working fluid flowing through the heat exchanger system, resulting in poor thermal efficiencies and drastically reduced engine performance compared to model predictions. Increasing the diameter of each tube to reduce the flow velocity results in reduced heat transfer of the fluid to the walls of the tube. Conversely, decreasing the diameter of the tubes to increase the heat transfer efficiency results in increased fluid velocity for a constant number of tubes. As the working fluid is caused to ingress and egress the heat exchanger orifices, the velocity of the the working fluid approaches the sonic velocity limits, resulting in reduced heat transfer efficiency due to the restriction of the total amount of fluid which may flow through the heat exchanger system. Another effect of sonic-limited flow is to cause significantly reduced power output of the engine since no useful work can be derived from the trapped working fluid both before or aft of the heat exchanger orifices.

A practical heat exchanger design is bounded by parameters seeking to maximize the thermal energy transfer rate and capacity, and to minimize the pressure, velocity and temperature of the working fluid consistent with the structural and thermal properties and loadbearing capability of the heat exchanger materials and components.

As gas working fluid expands or compresses through an orifice and connecting passageways of constant or varying cross section dimensions, energy is transferred between the walls of the chamber and the gas molecules. The characteristics of the energy transfer process occurring between the working fluid and the walls of the flow passageway are dependent on the thermodynamic conditions of the expansion or compression process (i.e., adiabatic, isothermal, isobaric, isentropic) and on the flow characteristics (i.e., laminae, turbulent, or transition) and boundary layer development near the walls of the flow passageway. The thermal efficiency of the heat exchanger is defined in terms of the capability to rapidly transfer heat energy between a working fluid medium and an external heat source and heat sink.

Regenerator effectiveness is generally defined in terms of the temperature difference which accompanies the heat transfer process between the working fluid and the walls of the regenerator. The sensitivity of the Stirling engine to the effectiveness of the regenerative component of the heat exchanger system is illustrated as follows: reducing the regenerator efficiency by two percent reduces the efficiency of the engine by approximately four percent. This is due to the fact that if the regenerator efficiency is reduced by two percent, then the extra quantity of heat must be made up by the input heat exchanger and by the heat output exchanger. Since the heat output is generally fixed by the available thermal sink temperature, the heat input exchanger makes up the total difference by operating at a higher temperature, which requires more fuel input while the shaft power output remains constant. This reduces the total efficiency of the engine for a given shaft power output. State-of-the-art regenerators consist of costly in-line stacks of fine mesh, stainless metal screens. Other regenerator designs have been tried, but the stacked metal screens have shown the highest regenerator effectiveness due to the associated high flow rates (velocity) of the working fluid.

Instead of a stack of fine mesh metal screens, the present invention uses a stack of thermally conductive and thermally insulating layers in alternating relation. The layers have communicating holes therethrough in a central area and have an outer nonperforated area to serve as a thermal reservoir in the case of the intermediate thermally conductive layers. The two outer layers are thermally conductive; one is heated outside of the central area and the other is cooled over most of its outer face. The intermediate thermally conductive layers take on heat energy from fluid passing from the hot to the cool end of the heat exchanger and release heat energy to fluid passing in the reverse direction. Such a stack of alternating layers will hereinafter be referred to as "SAL." The communicating holes through the layers provide continuous passageways through the stack. Preferably, the holes alternate in size from layer to layer to provide multiple expansion chambers along the length of each passageway.

This invention aims to improve the overall performance and thermal efficiency for Stirling and other heat engines by increasing the total orifice cross-sectional area and simultaneously increasing the surface area available for heat transfer in the flow passageways while maintaining structural reliability and safety. Increasing the orifice area effectively reduces the Reynolds numbers or flow characterization indices of the working fluid medium contained by the heat exchanger system and, in particular, reduces the Reynolds numbers in the regenerator. As an example, the heat exchanger section used in a single Stirling 4-95 engine cylinder is comprised of 18 tubes, each being 3 mm in diameter, for a total cross-sectional area of the heat exchanger orifice of (127.23 mm 2) compared to a piston area of (2375.82 mm 2), which is a ratio of only (0.0535) or 5.35% of the total piston area. In contrast, the heat exchanger of this invention can be made such that the total entrance port area of the orifices equals a cross-sectional area of 50.0% of the total piston area and, furthermore, accomplish this by providing many more flow passages, which can be much smaller (1 mm diameter), resulting in greater heat transfer efficiency. The flow rates are greatly reduced due to the larger total cross-sectional orifice area and the gas working fluid can flow more easily through the heat exchange system. Furthermore, the flow passageways of the heat exchanger disclosed in this invention may be given a total length which is comparable to the stroke of the piston travel of the engine rather than several times this stroke length as compared to the use of metal tubes. This shorter flow path length results in less trapped gas working fluid and hence increased heat exchange efficiency.

The regenerator and heat input and output exchangers must be efficient due to the frequent flow reversals which may occur in an engine during operation. For example, at an engine crankshaft rotational speed of 3000 rpm or 50 Hertz, the entire cycle time for heat transfer into and out of the gas working fluid occurs within 0.02 seconds. Thus a very short time interval is available during which the gas working fluid must accomplish the heat exchange process. The efficiency is governed in part by the thermal conductivity of the gas working fluid.

A high-power and efficient Stirling engine using air as a gas working fluid is highly desirable. Hydrogen and helium are two of the most thermally conductive dry gases, being approximately nine times more conductive than dry air. However, air saturated with water vapor as a gas working fluid exhibits high thermal conductivity comparable to helium, but is more viscous and is constrained to move at a slower bulk velocity. The heat exchanger system disclosed in this invention allows wet air to be efficiently used as a gas working fluid in a Stirling engine due to the large frontal orifice area of the heat exchanger flow passageways relative to the piston face area.

Another object of this invention is to significantly reduce the overall weight and dimensions of the Stirling and other heat engines using a SAL heat exchanger as compared to state-of-the-art engines using the relatively heavy, lengthy, and bulky parallel arrangements of finned, strategic metal alloy tubes. The weight of the regenerator and heat exchanger components is determined by the product of the value of the mass density of the materials in the respective components and the value of the heat capacity of said materials consistent with temperature variations allowed in the thermal management system. By the present invention, the thermal load capacity of a heat exchanger may be increased or decreased simply changing the number of layers in the stack and by increasing the dimensions of the perimeter or nonperforated region of said layers.

A still further objective of this invention is to reduce the cost of the regenerator components by replacing the costly stainless metal screens in state-of-the-art regenerators with a relatively low-cost, stacked, alternating layers regenerator while still maintaining a high regenerator effectiveness due to the reduced flow rates (velocity) of the working fluid in the regenerator. In the preferred embodiment of this invention, the regenerator stack serves to locally and rapidly store and recover heat energy from the working fluid and to thermally insulate the heat input heat exchanger which is continuously supplied heat energy from an external heat source from the heat output heat exchanger which is continuously expelling heat energy to an external heat sink. The hole patterns in the stacked, alternating layers are arranged such that the gas working fluid alternates between local compression and expansion chambers in the flow passageways. This is accomplished by simply alternating the hole diameters in adjacent layers in the regenerator, thereby forming localized chambers in the flow passageways. As the gas is caused to ingress into a larger chamber, expansion occurs; and as the gas egresses to the next smaller chamber, compression occurs. This localized compression/expansion process occurs continuously as the working fluid flows through the heat exchanger and regenerator and acts to increase the rate of heat transfer between the working fluid and the walls of the flow passageways. This reduces the amount of nonparticipating or adiabatic working fluid contained in the center of the flow stream and acts to substantially improve the overall efficiency of the engine or the heat pump.

A still further objective of this invention is to increase the capability of the Stirling-type engine to use many types of heat energy sources and sinks including radioactive sources. This is made possible because all of the layers of the heat exchanger can be or ceramic materials which are adapted for use in a radioactive environment.

This invention also aims to balance or uniformly distribute the temperature gradients existing near the reciprocating piston face opposite the heated, outside, thermally conductive layer of the SAL. State-of-the-art metal tube designs position the metal tubes of the heat exchanger in a line across the face of the piston, resulting in nonuniform temperature gradients both radially and circumferentially about the cylinder axis. The orifices of each flow passageway existing in each layer of the heat exchanger as described by this invention are more evenly distributed across the face of the piston, thus acting to uniformly distribute the temperature of the gas flowing in the heat exchanger.

A yet further objective of this invention is to substantially reduce the hoop stress loads due to pressure and to improve the safety and reliability of high-temperature and high-pressure heat exchanger and regenerator components. The hoop stresses are safely mitigated in the layered heat exchanger structure by simply increasing the outer dimension or diameter of each layer. In the event that a single flow passageway wall cracks or fails, there will not be any resulting leakage or catastrophic failure of the system unless the crack extends completely through to the exterior of the entire layer structure. It is also well known in brittle failure theory that each hole of a pattern of small holes contained by a structure and subject to positive internal pressure loads will each act individually as stress risers. However, a crack trying to propagate through the entire structure will be deflected by the small holes and will have its propagation energy absorbed by said holes which are contained in the structure, thus acting to inhibit crack tip propagation and thus act to prevent catastrophic failure of the heat exchanger. Hence the SAL heat exchanger of this invention has a higher safety factor as compared to state-of-the-art, tube-type heat exchangers.

DESCRIPTION OF THE DRAWINGS

FIG. 5 is a view of a half cross section showing a rectangular grid hole pattern contained in the regenerator and heat exchanger layers.

FIG. 6 is a partial view of a median section of the regenerator stack illustrating the alternating size of the holes contained by each layer in the stack.

FIG. 7 is an enlarged view of a median section showing one segment of alternating layers comprising a flow passageway illustrating the working fluid flow direction and associated heat storage or local flow direction into the thermally conductive layers.

FIG. 8 is an enlarged view of a median section showing one segment of alternating layers comprising a flow passageway illustrating the reversed fluid flow direction and associated heat recovery of local heat flow direction out of the thermally conductive layers and into the working fluid stream.

FIG. 9 is a schematic of a Stirling-type engine showing the location of the heat exchanger/regenerator of the present invention and related components.

DESCRIPTION OF INVENTION

Figure 1:
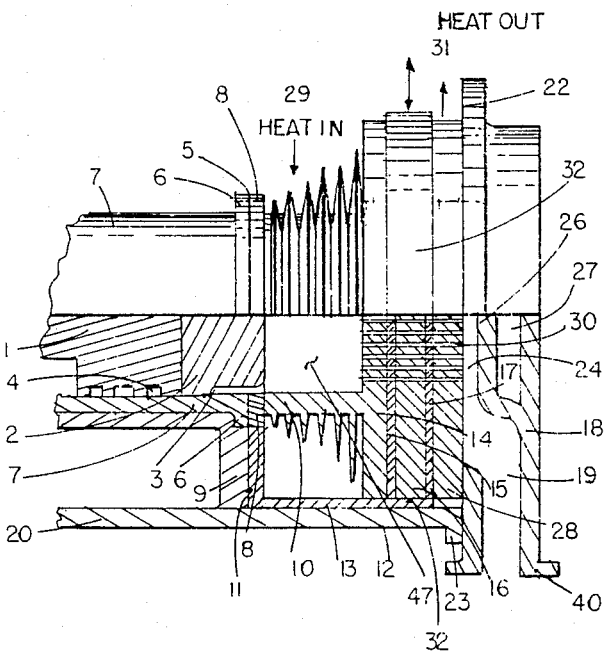
FIG. 1 is a view of the stacked, alternating layer regenerative heat exchanger system attached to a Stirling heat engine structure with a partial median section along the cylinder axis.
Figure 2:
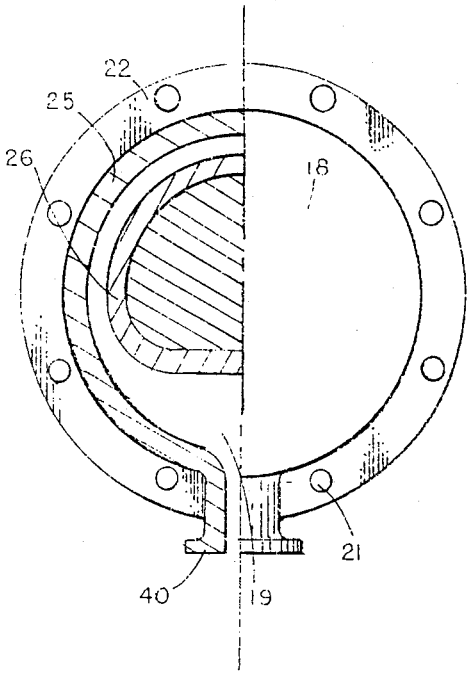
FIG. 2 is a top view of FIG. 1 showing the main duct flange connection and outer cap on the heat output heat exchanger.
Figures 3, 4:
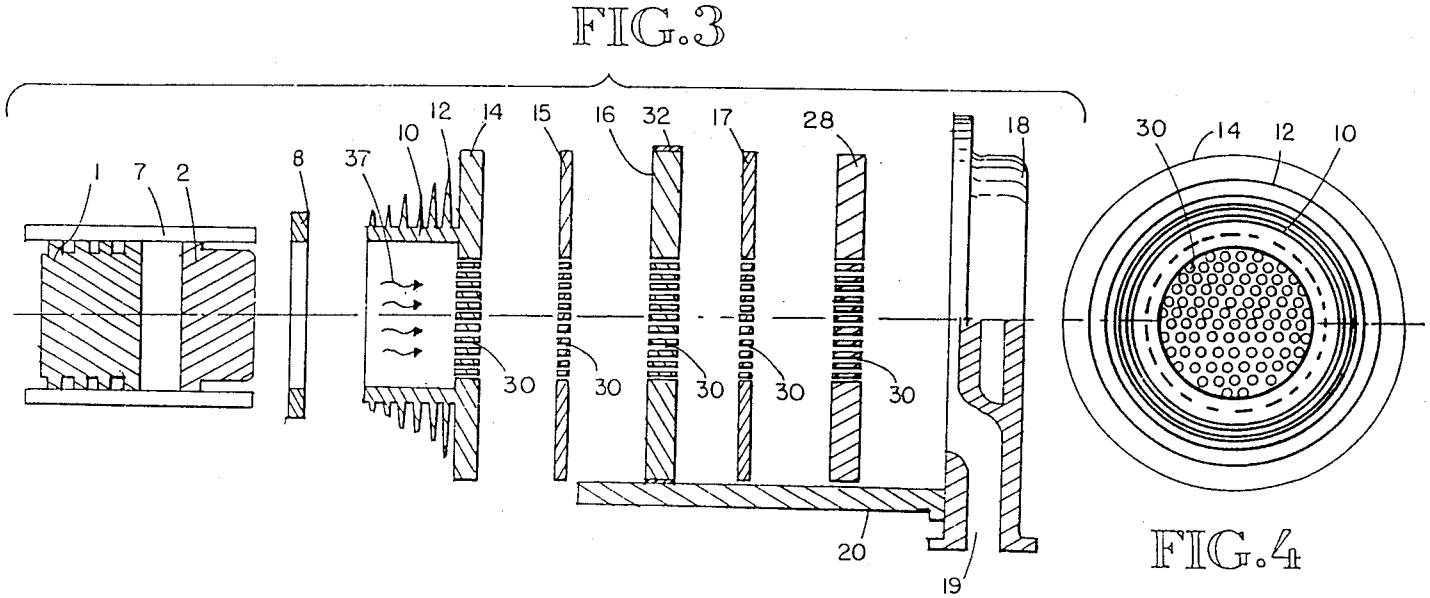
FIG. 3 is an exploded view of the heat exchanger with the intermediate structure and a partial reciprocating piston and associated manifolds and ducts.
FIG. 4 is a top inside cross-sectional view of the regenerator and heat exchanger stacked layers, illustrating a close-packed hole pattern comprising flow passageways along the cylinder axis.

FIG. 1 depicts a partial median section of a stacked, alternating layer heat exchanger operating in conjunction with a conventional reciprocating piston [1] which is positioned at the bottom of the stroke travel. An insulating piston cap [2] with an annular clearance gap [3] is attached to said piston [1] to minimize heat rejection through the face of the piston and into the engine cavity. In the embodiment shown in FIG. 1 and accompanying exploded view in FIG. 3 and top views in FIGS. 2 and 4, the piston rings [4] will not cross the boundary [5] defined between flange [6] of cylinder [7] and insulating ring [8]. The reciprocating piston [1] reciprocates in cylinder [7]. Cylinder [7] is supported by means of cylinder flange [6] which adjoins cylinder support structure [9]. An insulating annular top ring [8] is positioned between cylinder flange [6] and the base of intermediate hot structure [10]. A larger insulating annular ring [11] adjoins and contains the outer perimeter of said annular top ring [8], and one face of said larger insulating ring [11] adjoins the top face of cylinder support structure [9] and the inner wall of housing [12]. The housing [12] contains the internal components and is partially insulated on the inner wall surface by an insulating annular cylinder [13]. Insulating annular cylinder [13] adjoins the large insulating annular ring [11] and further adjoins the outer perimeters of hot plate [14], inner insulating layer [15], regenerator [16], and outer insulating layer [17]. A cold cap [18] containing flow port [19] adjoins housing [20] and is affixed by bolts through holes [21] located on cold cap flange [22], which engages housing flange [23]. A cold chamber [24] is formed between the inner surface of cold cap wall [25] and the working fluid impingement wall [26]. The working fluid impingement wall [26] may be water-cooled through cavity [27].

The simplest heat exchanger according to this invention comprises a simple arrangement of stacked or adjacent layers [14,15,16,17, 28] whereby each layer is comprised of materials with alternating high coefficients [14,16,28] and low coefficients [16,17] of thermal conductivity and matching or similar coefficients of thermal expansion in the geometric plane of each layer [14,15,16,17,28]. The stacked layers are comprised of the following: an outer thermally conductive layer [14] and related structure [10] having heat fins [12] for heat input [29], a thermally conductive layer [28] in contact with flange [22] of thermally conductive cold cap [18] for heat output [31], and a regenerative layer [16] which is thermally insulated by two intermediate layers [15,17] and by an outer ring [32]. Flow passageways [30] extend through the stacked layers and are substantially gastight with respect to the exterior edges of the heat exchanger. Alternate hole patterns following a rectangular grid, as illustrated in FIG. 5, contained by each of said layers [14,15,16,17,28], may be desired, depending on the forming method for the orifices comprising the flow passageways [30].

Referring to FIG. 6, in the preferred embodiment of this invention, the insulating layers [15,17] and regenerative layer [16] may instead comprise a combined stack [34] of several thin layers [35,36] of materials of alternating low coefficients [35] and high coefficients [36] of thermal conductivity but similar coefficients of thermal expansion, and arranged such that the stack [34] is thermally conductive in the geometric plane of each layer [36] but is insulated through the depth of the stack so that the stack [34] thermally insulates and separates the heat input layer [14] from the heat output layer [28]. The passageways through the layers which form the passageways 30 are alternated in diameter, as indicated by smaller orifices [30*a*] and larger orifices [30*b*].

The following is a description of the operation of the stacked, alternating layer heat exchanger system with a multilayer regenerator as shown in FIGS. 6, 7 and 8 during an engine or heat pump cycle. In a complete engine cycle whereby said reciprocating piston [1] travels upward from the minimum stroke travel to the maximum stroke travel and downward from maximum to the minimum again, the working fluid [37] is thereby caused to reversibly flow through flow passageways [30] which are contained in respective layers [14,34,28]. Heat energy is continuously provided to the exterior regions of heat input layer [14] and finned intermediate hot structure [10] and subsequently exchanges or transfers said heat energy to gas working fluid [37] by conductive and convective processes occurring on the interior walls of said structure [10,14] and as the gas flows through the flow passageways contained in layer [14]. The heat input layer [14] and finned intermediate hot structure [10] are insulated from the rest of the engine structure by a gastight ring [8] which is comprised of an insulating material, such as stabilized zirconia, which prevents substantial heat loss. The intermediate hot structure [10] and fins [12] may be an integral or bonded part, with the heat input layer [14] depending on material selection and fabrication method so as to better form a gastight seal.

FIG. 7 depicts local heat storage [39] in the multilayer regenerator [34] during upward stroke travel of piston [1], whereby the gas working fluid [37] is caused to flow from the heat input layer [14] towards the heat output layer [28] through said flow passageways [30]. The gas working fluid [37] then reaches the heat output layer [28] and flows through the flow passageways [30] therein contained, impinges on the interior walls [26] of the cold cap [18], and flows out the exit port [19] and into a duct (not shown) which connects to flange [40]. Heat energy is continually being removed from the exterior surfaces of heat output layer [28] and cold cap [18] and finally to the external thermal sink [31]. A heat energy exchange process occurs between said working fluid [37] and the interior surfaces of the heat input layer [28] and cold cap [18], resulting in transfer of heat energy from the gas working fluid [37] to the thermal sink [31]. During the downward stroke travel of said piston [1], the gas working fluid [37] flows from the heat output layer [28] toward the heat input layer [14], and local recovery of heat energy [41] previously stored in the multilayer regenerator [34] occurs as depicted in FIG. 8.

The alternating hole sizes [30*a*, 30*b*] in the layers of the stack provide an arrangement in which the gas working fluid alternates between local compression chambers [30*a*] and expansion chambers {30*b*] in the flow passageways [30]. The resulting compression/expansion cycle acts to increase the rate of heat transfer to the thermally conductive layers [36]. It is preferred that the holes [30*a*, 30*b*] be sufficiently small to obtain good heat transfer between the working fluid [37] and the thermally conductive layers [36]. The holes may be circular or have other suitable shapes such as a chevron, for example. It is practical to have circular openings as small as 1 mm in diameter. Regardless of hole shape or size, it is critical that there by a large enough nonperforated area [40] in the layers of the heat exchanger that the total combined heat storage capacity of the thermally conductive layers [36] is adequate for regeneration.

Referring to FIG. 9, a standard Stirling cycle engine is illustrated schematically and labeled with the normal Stirling engine terminology and the corresponding parts shown in FIG. 1. It will be noted that the piston [1] is the displacer and may be double ended, in which case the two piston ends should be thermally insulated from one another. The compression piston [38] may be aligned with the displacer piston so that they function as opposed pistons in a cylinder in the engine. A power output mechanism such as a Scotch yoke coupled to the crankshaft and engaged by the compression piston may be used.

It is preferred to utilize the advantages of ceramics in forming the intermediate layers of the heat exchanger stack. Candidate ceramic materials which exhibit high thermal conductivity must also exhibit material phase stability over the expected temperature regions, adequate strength when subject to the temperature and pressures, chemical inertness, and impermeability to the gas working fluid, high thermal shock resistance, and reasonable cost. Diamond and beryllia are two possible materials exhibiting high thermal conductivity, but would be normally cost-prohibitive. Practical candidate high performance, thermally conductive ceramic materials are alumina, alumina nitrides, silicon nitrides, silicon carbides, and carbon composites. Candidate ceramic materials which exhibit low thermal conductivity include zirconia, silica, glass-ceramics, boron nitride, and other ceramic matrix composites. The simple geometry requirements of the stack layers permit ceramic components and allow the fabrication costs to be minimized.

The end layers [14,28] of the heat exchanger will normally be steel or other suitable metal for structural strength as well as thermal conductivity. It is preferred to utilize the advantages of ceramics in forming the intermediate layers of the stack. The process of laying down ceramic layers can be achieved by several methods. Fabricating the layers at low cost can be realized by using a modified tape cast process. Tape casting thin layers of ceramic materials is an attractive fabrication technology. Fabrication methods on brittle ceramic materials are generally difficult and limited as compared to the forming and fabrication methods available for ductile metals and flexible polymers. The advantages of the tape casting process are the high-volume capability and the ease of fabrication of brittle ceramic components by performing most of the forming operations while the tape is in a flexible green state. The fabrication of multilayer ceramic capacitors for the electronics industry is generally accomplished using tape casting processes. In the tape casting process, the desired composition of ceramic powder materials is first mixed into a slurry containing fugitive organic or polymeric binders; the slurry is then doctor bladed onto polymer transfer tapes; the atmosphere in the tape cast process may be closely controlled if the process is enclosed; the polymeric binder in the resultant tape is then cured, resulting in a relatively tough film of ceramic powders bound by the polymeric matrix. This film can then be separated from the polymeric transfer tape; and subsequent fabrication operations, such as hole punching, cutting to size, and metallization can be accomplished on the ceramic/-polymer cured tape.

Fabrication of at least two tapes, one containing a low thermal conductivity ceramic material, such as zirconia, for insulating layers [35], and another containing a relatively high thermal conductivity ceramic, such as silicon carbide for the thermally conductive layers [36], would best accomplish the desired stacked alternating layers of low and high thermal conductivity ceramics. Holes of specified size, shape and pattern would be punched into each of the respective tapes. The tapes could then be cut according to the overall size and shape requirements. Several alternating layers, consisting of the thin disks of ceramic with the hole patterns positioned or indexed accordingly, could then be stacked and heat treated and/or fired to remove the polymeric binder and to consolidate or sinter together the ceramic layer components.

Another method of fabrication of the individual layers utilizes cast iron and flame-sprayed zirconia ceramic material. Flame spraying, chemical vapor deposition, physical vapor deposition, plasma deposition, and laser-assisted reactive gas deposition are among the state-of-the-art methods for depositing thin layers of ceramic materials onto a suitable substrate. Flame spraying is the preferred and most commonly used state-of-the-art method for deposition of reasonable strength ceramic layers, whereby powder and rods of ceramic materials are impelled by air or other gas propellant flowing at high velocities through a portable or movable nozzle which also contains an energy source (such as a carbon arc) which is of sufficient magnitude to rapidly heat the incoming ceramic power or rod materials above their melting points and, subsequently, said propellant impels said molten material towards the deposition target or substrate. In the preferred embodiment of this invention, utilizing the flame spraying technique, the substrate is cast iron to function as a thermally conductive layer [36], and the flame-sprayed ceramic is zirconia to function as an insulating layer [35]. The resultant combination of cast iron substrate and flame-sprayed zirconia is subsequently post densified with chromic oxide ceramic. The surface of the now chromia-densified zirconia is then ground to a uniform layer thickness and surface finish. Flame spraying is a fabrication method well suited to volume production if both the substrate and resulting deposited layer consist of simple line-of-sight geometries, namely, flat, thin-layered disks as described in this invention. The hole patterns in the respective layers can be accomplished either using standard hole forming techniques, such as drilling, or a high rate material cutting device known as a "water-jet cutter" can be used. The water-jet cutter consists of a nozzle ejecting a stream of high-pressure water which is aimed by computer-controlled machinery along the surface to be cut.

Another low-cost method of fabricating the heat exchanger components is to fabricate sheet metal discs, having a pattern of holes which comprise the flow passageways, using a drop hammer or cold punch press forming technique, and subsequently apply insulating refractory cement which is brushed, dipped, spray painted or screen printed onto the metal plate, thus forming two layers bonded together, one of which (the sheet metal) has high thermal conductivity and one of which (the refractory cement) has low thermal conductivity. Several of these two-layer assemblies are then stacked onto each other with said pattern of holes aligned such that connecting flow passageways result through the thickness of the stack. At this point in the process, the holes forming said flow passageways may need to be cleared of ceramic material by passing the plates over high-pressure air, causing any loose material to be cleared from the formed holes. This stack is then heat treated to drive off the volatiles in the refractory paint or cement.

The heat exchanger may have a single thermally conductive regenerator layer [16] formed of a porous, solid thermally conductive material in which the pores provide the flow passages through the thickness of the regenerative layer. An example of such a material is low-density reaction-bonded silicon nitride.

Although the foregoing invention has been described, in part, by way of illustration for the purposes of clarity and understanding, it will be apparent that certain changes or modifications will be practiced without deviating from the spirit and scope of the invention.

I claim:

1. A regenerative heat exchange system comprising:

a set of alternating solid layers of thermally insulating material and thermally conductive material each having an array of passageways through its thickness which communicate with passageways in adjacent layers, there being at least three of said thermally conductive layers, two of which are at opposite ends of said set, and the remainder of which are intermediate regenerative layers;

heat energy supply means for constantly applying heat energy to the thermally conductive layer at one end of said set;

heat energy removal means for constantly removing heat energy from the thermally conductive layer at the other end of said set;

respective end chambers communicating with said arrays of passageways of the thermally conductive end layers at the ends of said set; and means for alternately supplying and discharging a heat-energy transporting compressible fluid to and from said end chambers to thereby alternate the flow direction of said fluid through said passageways, whereby heat energy is transferred directly from said fluid to said regenerative layers in one direction of travel of said fluid, and is transferred directly from said regenerative layers to said fluid in the opposite direction of travel of said fluid, said regenerative layers collectively having sufficient heat capacity for regeneration.

2. A regenerative heat exchange system according to claim 1 in which the passageways in some of said layers are larger than the passageways in others of said layers.

3. A regenerative heat exchange system according to claim 1 in which the passageways in said intermediate regenerative layers have a different cross-sectional area than the passageways in said thermally insulating layers.

4. A regenerative heat exchange system according to claim 1 in which the periphery of said intermediate regenerative layers is thermally insulated.

5. A regenerative heat exchange system according to claim 1 in which the periphery of said intermediate regenerative layers and of the thermally conductive layer to which heat energy is applied, are thermally insulated.

6. A regenerative heat exchange system according to claim 1 in which said heat energy supply means includes a cylinder surrounding the entry to the array of passageways in the end thermally conductive layer to which heat is applied.

7. A regenerative heat exchange system according to claim 6 in which a heat chamber surrounds said cylinder and said cylinder has external heat exchange fins in said heat chamber.

8. A regenerative heat exchange system according to claim 6 in which a piston operates in said cylinder and has a thermally insulated head opposite the entry to the array of passageways in the thermally conductive end layer to which heat is applied.

9. A regenerative heat exchange system according to claim 6 in which said heat energy supply means applies heat to an outer area of said thermally conductive layer at one end of said set which is spaced toward the periphery of a central area containing the array of passageways through such end layer.

10. A regenerating heating exchange system according to claim 1 in which there is an intermediate regenerative layer formed of a porous thermally conductive material in which the pores connect the passageways through the adjacent layers.

11. A regenerative heat exchange system according to claim 1 in which said heat energy removal means acts on most of the area of said thermally conductive layer at the other end of said set.

12. A regenerative heat exchange system according to claim 1 in which said thermally insulating material is ceramic.

13. A regenerative heat exchange system according to claim 1 in which said thermally insulating material and thermally conductive material are ceramics.

14. A regenerative heat exchange system according to claim 1 in which said thermally insulating material is ceramic and said thermally conductive material is metal.

15. A regenerative heat exchange system according to claim 1 in which said layers at the end of said set are metal, and the remainder of said layers are ceramic.

16. A regenerative heat exchange system according to claim 1 in which said thermally conductive layers are metal and said thermally insulating layers are ceramic.

17. A heat exchanger comprising:

a set of alternating thermally insulating and thermally conductive layers each having an array of passageways through its thickness which communicate with respective passageways in adjacent of said layers, there being at least three of said thermally conductive layers, two of which are at opposite ends of said set, and the remainder of which are intermediate regenerative layers;

the passageways in said thermally conductive layers having a different cross-sectional area than respective communicating passageways in said thermally insulating layers.

18. A heat exchanger according to claim 17 in which said passageways are located in a central area of said layers and there is an unperforated outer area for heat energy storage by each heat conductive layer which is insulated on both of its sides by said thermally insulating layers.

19. A heat exchanger according to claim 18 in which some of said layers are ceramic.

20. A heat exchanger according to claim 18 in which the thermally conductive layers at the outer end of said set are metal and are thicker than the other layers.

21. A heat exchanger according to claim 20 in which some of said other layers are ceramic.

* * * * *